US010138016B2

(12) United States Patent
Baryshyan

(10) Patent No.: US 10,138,016 B2
(45) Date of Patent: Nov. 27, 2018

(54) COATED BOX WITH ANTI-GREASY FINGERPRINT COATING

(71) Applicant: FC Meyer Packaging LLC, Norwalk, CT (US)

(72) Inventor: Matthew Arthur Baryshyan, Stormville, NY (US)

(73) Assignee: FC Meyer Packaging LLC, Norwalk, CT (US)

( * ) Notice: Subject to any disclaimer, the term of this patent is extended or adjusted under 35 U.S.C. 154(b) by 551 days.

(21) Appl. No.: 14/814,854

(22) Filed: Jul. 31, 2015

(65) Prior Publication Data

US 2017/0029161 A1 Feb. 2, 2017

(51) Int. Cl.

| | |
|---|---|
| ***B65D 5/56*** | (2006.01) |
| ***B31B 1/74*** | (2006.01) |
| ***B65D 5/62*** | (2006.01) |
| ***B31B 50/74*** | (2017.01) |

(52) U.S. Cl.
CPC ..... *B65D 5/563* (2013.01); *B31B 50/74* (2017.08); *B65D 5/62* (2013.01); *B31B 50/747* (2017.08)

(58) Field of Classification Search
CPC ..... B65D 2581/3479; B65D 75/18; B65D 81/3823; B65D 81/3874; B65D 5/56; B65D 2585/363; B65D 65/42; B65D 81/3446; B31B 50/622
USPC ..... 264/41
See application file for complete search history.

(56) References Cited

U.S. PATENT DOCUMENTS

| | | | | |
|---|---|---|---|---|
| 3,863,832 | A | 2/1975 | Gordon | |
| 5,635,279 | A * | 6/1997 | Ma | D21C 5/02 427/411 |
| 5,837,383 | A * | 11/1998 | Wenzel | B65D 65/42 428/486 |
| 2003/0152724 | A1* | 8/2003 | Swoboda | B65D 65/42 428/34.2 |
| 2006/0148628 | A1* | 7/2006 | Lorenz | C09J 123/0853 493/68 |
| 2009/0114340 | A1* | 5/2009 | Bucco | B31F 1/2809 156/321 |

* cited by examiner

*Primary Examiner* — Yan Lan
(74) *Attorney, Agent, or Firm* — Robert J. Hess; Hess Patent Law Firm

(57) ABSTRACT

A coated box with anti-stain coating on portions of exterior surfaces of the coated box, which also has uncoated exterior surfaces to which a water-based adhesive is applied to adhere to portions of an interior facing surface to form a box shape that includes folds at creases at scored lines.

16 Claims, 6 Drawing Sheets
(6 of 6 Drawing Sheet(s) Filed in Color)

COATED BOX WITH ANTI-GREASY FINGERPRINT COATING

BACKGROUND OF THE INVENTION

Field of the Invention

The invention relates to an anti-greasy finger coated box that is coated with a conventional barrier coating on the inside and an anti-greasy fingerprint coating on the outside except at joints that are left uncoated where a water-based glue is to be applied.

Discussion of Related Art

Take-Out Packaging

Take-out packaging made from 100% recycled uncoated paperboard is excellent for use in large municipal markets, especially now that Styrofoam as a packaging medium is being phased out in some municipal markets due to the non-recyclable nature of Styrofoam. Styrofoam is an expanded rigid polystyrene plastic.

100% Recycled Uncoated Paperboard

100% recycled uncoated paperboard is made from a high percentage content of post-consumer waste content paper, which may contain mixed paper, retired books, old magazines, newspaper and old corrugated boxes. The phrase "post-consumer waste" means that the fibre has been reclaimed from materials that have already passed through the consumer's hands. The result is a paperboard that is not coated on either side and is highly susceptible to grease absorption and staining, making the most sustainable, least expensive paperboard the least likely substrate to use for direct contact food packages for the following reasons:

1. Grease and water absorption into the paperboard
2. Inability to utilize the material for refrigerated products due to atmospheric moisture absorption into the paperboard.
3. Unsightly greasy fingerprints on the surface of the paperboard, giving a poor appearance.

To provide a surface that can withstand the absorption of atmospheric moisture and/or grease, the surface must be treated with a coating that seals in the surface of the paperboard. Such a coating may be a conventional barrier coating.

F.C. Meyer Packaging Meyercote Coating

F.C. Meyer Packaging has a website at http://www.fc-meyer,xin/sustainability.html The materials used in folding carton manufacture are described and there is a link to a demonstration video. It offers a grease resistant coating under the tradename MEYERKOTE that is available commercially to be applied to 100% recycled post consumer waste paperboard. The application of this grease resistance coating provides an oily surface texture with a glossy appearance (i.e., shiny and smooth) that effectively prevents absorption of grease into the paperboard thereby preventing stains.

Conventional Manufacture of a Paperboard Box

According to an article entitled FOLDING CARTONS, published online under the heading Packaging technology at http://packagingtech.net/56-folding-cartons.html?newsid=56:

Paperboard Selection

Successfully meeting the needs of a folding-carton user begins with choosing the paperboard best suited for the job. In general, this means selecting the grade with the lowest cost per unit area that is capable of satisfying the performance requirements of the specific application. Economics and performance dictate careful selection of paperboard grades for each use.

Selection Criteria

A variety of criteria are commonly used in the selection of paperboard grades. The Technical Association of the Pulp and Paper Industry (TAPPI) has published standardized test methods for many of these criteria (3) (see Testing, packaging materials). TAPPI Standard Methods are widely used and accepted by the industry. The most important and widely used criteria are shown below.

FDA/USDA Compliance.

This is a nondiscretionary criterion for food products and is dependent on the type of food and the type of contact anticipated between the food and the paperboard or coatings on the paperboard.

Color.

Color is typically chosen for marketing reasons. The side of the paperboard that becomes the outside of the carton is generally white, but the degree of whiteness varies among grades. Depending on the materials-selection and processing strategies of suppliers, outside board color can be blue-white or cream-white. These shades are noticeably different and can limit substitution of grades. Board color on the inside of cartons varies from white to gray to brown.

Physical Characteristics.

It is possible to establish minimum levels for each carton application that allow the package to satisfactorily withstand the rigors of packaging machinery, shipping, distribution, and use by the consumer. Physical properties commonly used to predict suitability of board for a given use include stiffness, tear strength, compressive strength, plybond strength, burst strength, tensile strength, elongation, and tensile energy absorption. Physical criteria normally define the basis weight and thickness of paperboard that is used to produce a carton.

Printing Characteristics.

Following the selection of a specific graphic design and printing method for the carton, a paperboard is selected based on these criteria: smoothness; coating strength; ink and varnish gloss; mottle resistance; and ink receptivity. Not all criteria are important for every printing technique.

Barrier.

The most common barrier requirements are for cartons to provide protection against moisture and grease. The choice of a barrier material and application method influences board choice. For example, if polyethylene (PE) is to be applied to the carton, a board with a treatment that holds the PE on the board surface can have economic and processing advantages over an untreated board. Materials and application methods are described below.

Paperboard Types

In the United States, the three most widely used types of paperboard are identified as follows:

Coated Solid Bleached Sulfate (SBS). 100% virgin, bleached, chemical furnish, clay-coated for printability.

Coated Solid Unbleached Sulfate (SUS). 100% virgin, unbleached, chemical furnish, clay-coated for printability.

Coated Recycled. Multiple layers of recycled fibers from a variety of sources, clay-coated for printability.

Coated recycled boards are the most widely used. Other types include folding box board (FBB) and white lined chipboard (WCC).

Overall treatments or coatings are applied to webs of paperboard to provide specific functions. Clay-based coatings to provide high-quality printing surfaces are the most common treatment applied on the paperboard machine. Grease-resistant fluorochemicals are applied on board machines as well, either as furnish additives, surface treatments, additives to clay coatings, or in combination. Mold-inhibiting chemicals are also applied to boards designed for bar-soap packaging, to prevent moisture in the product from initiating mold growth. Surface treatments applied on other-than-board production equipment are discussed below under Carton Manufacturing Processes.

Carton Manufacturing Processes

After a paperboard grade has been selected for a specific carton style and use, a variety of manufacturing options are available for converting that board into cartons. Although it is a highly unusual carton that requires each one of the steps or stages described below, all are commonly employed to produce folding cartons in today's market.

Extrusion Coating

This technique involves the coating of one or both sides of the paperboard web with a relatively thin (generally less than 0.001-in. (25.4-mm)) layer of a thermoplastic polymer (see Extrusion coating). Low-density polyethylene (LDPE) is the most commonly used extrusion coating for folding cartons and provides a cost-effective means of obtaining excellent protection against water resistance as well as a fairly good water-vapor barrier. LDPE is also used as a heat sealant (see Sealing, heat), particularly when twoside coatings are employed. When the use temperature of the package exceeds 1501 F (651 C), HDPE or PP can be used to raise the acceptable use temperature to 2501 F (1211 C). These two polymers also provide improved grease resistance. Coating board with PET can raise the use temperature to over 4001 F (2041 C), suitable for most "dual-ovenable" applications. Coextrusion, in which back to-back layers of two plastics are laid onto paperboard, makes it possible to take advantage of the special properties of some exotic plastics, such as nylon, that by themselves will not adhere to paperboard.

Laminating

The earliest means of significantly enhancing the properties of paperboard was the combination with other materials through lamination (see Laminating). The most commonly used laminating adhesives are water-based glues (see Adhesives), or thermoplastic polymers. Materials laminated to paperboard include high-quality printing paper for enhanced graphics capabilities (see Paper), grease- or water-resistant paper for improved barrier, aluminum foil for barrier or aesthetics (see Foil, aluminum), and film (sometimes metallized) for barrier or aesthetics (see Metallizing).

Printing

Prior to the printing operation, paperboard is handled in web form. A decision must be made to continue in web form or convert the web to sheets before printing and die cutting. This choice is primarily dictated by the printing technique chosen (see Printing). Sheeting is most often done at the carton-producer's facility. A small segment of the industry purchases board sheeted at the paperboard mill.

The main processes for carton printing today are offset lithography, flexography, and gravure. Letterpress and silk screen are used to a limited extent. The most recently introduced process, digital printing, can be used for short print runs and for customizing packaging in already premade bulk. Printing involves solid print, text, illustrations, and diagrammatic representatios. Brand positioning can have a major influence on the printing design. Functional needs have to be taken in to account. Products that retain ink odors require special attention in choice of inks and printing methods. Products that are packed hot may need rub-resistant print surfaces.

Cutting and Creasing

Following the printing operation, individual cartons are cut from webs or large sheets and creased or scored along desired folding lines. Reciprocating flat-bed or platen cutting is almost invariably used to cut and crease sheets printed by offset lithography. In this technique, an accurately positioned array of steel cutting knives and scoring rules is pressed against a printed sheet of paperboard. The knives penetrate through the paperboard to cut out the pattern of the carton. Rules force the board to deform into channels in the counter plate, producing controlled lines of weakness (scores) along which the board will later predictably bend or fold. Alternatively, scores can be produced by cutting partially through the paperboard or by alternating uncut segments with completely cut-through segments.

Gluing

Although more and more packaging machinery is designed to accept flat carton blanks (see Cartoning Machinery), gluing still represents a major and important converting operation. The simplest operation converts a flat blank into a side-seamed tube or glued shell. Carton blanks are removed one at a time from a stack and carried by sets of endless belts. Stationary curved plows move one or more panels of the blank out of the original plane to either prebreak scores or form the glue seam. Prebreaking of scores assists packaging machine operation, since the force required to bend a previously bent score is greatly reduced. Sealing is accomplished with cold glues, hot melts, or heat sealing of polymers. Side-seamed cartons are discharged into a shingled delivery that provides compression and time to set the bond; case or bulk packing for shipment follows. Gluers in which the cartons move in a continuous straight line, transported by belts, are known as straight-line gluers. Although straight-line gluers are most commonly used to produce glued shell-type cartons, attachments provide the ability to produce automatic bottom as well as certain collapsible-tray styles. Paper or paperboard bridges can be attached to main panels during straight-line gluing. For simple styles, the feeding of carton blanks into the gluer does not need to be timed into specific folding actions. Complicated folding devices may dictate that blank feeding be timed, which generally reduces speeds. Compound folds in both directions on the blank cannot be handled by straight-line machines.

Water-Based Glues

Once the paperboard is coated, it is folded along its scored lines and certain end flaps are adhered to neighboring surfaces to keep the box in an assembled condition rather than flat. If the surfaces to be glued have an oily texture as would be the case for conventional barrier coatings, the water based glue will be unable to secure the surfaces to each other. The reason may be due to the surfaces being high tensioned from the conventional barrier coating.

Hot Glue

According to the online encyclopedia Wikipedia at https://en.wikipedia.org/wiki/Hot-melt_adhesive:

Hot melt adhesive (HMA), also known as hot glue, is a form of thermoplastic adhesive that is commonly supplied in solid cylindrical sticks of various diameters, designed to be melted in an electric hot glue gun. The gun uses a continuous-duty heating element to melt the plastic glue, which may be pushed through the gun by a mechanical trigger mechanism, or directly by the user. The glue squeezed out of the heated nozzle is initially hot enough to burn and even blister skin. The glue is tacky when hot, and solidifies in a few seconds to one minute. Hot melt adhesives can also be applied by dipping or spraying.

The present inventor is aware of throughput production problems that arise from the use of hot melt adhesives where the equipment responsible for maintaining the throughput jams and creates an interruption in the throughput of coated paperboard manufacture. Those problems are attributed to the time delay caused by the equipment jamming since the time delay is long enough for the hot melt adhesive to cool and thus become ineffective in adhering to surfaces it is yet to be applied to.

For instance, the hot melt can be used at joints to adhere two opposing surfaces to each other during the formation of a box from paperboard that folds along creases at scored lines. However, if the hot melt is only applied to one or both of the surfaces and the throughput equipment jams, then the hot melt that was deposited (before opposing surfaces that are supposed to be adhered to each other are brought together) cools and is rendered incapable of adhering. When the jam is fixed and the equipment runs again, bringing together the opposing surfaces will be too late for any adhering to occur because the hot melt has already cooled.

Thus, in the case of paperboard, the present inventor surmises that a number of successive paperboards may need to be discarded if the paperboard throughput equipment jams and the adhesion becomes deficient for that number of successive paperboards. Some sort of inspection will be needed to identify the defectively adhered paperboards so they can be discarded accordingly.

Central Impression Flexographic Presses

Central impression flexographic presses are conventional. According to the online encyclopedia Wikipedia at https://en.wikipedia.org/wiki/Flexography:

Operational Overview

1. Fountain Roller

The fountain roller transfers the ink that is located in the ink pan to the second roller, which is the anilox roller. In Modern Flexo printing this is called a Meter or "metering" roller.

2. Anilox Roller

This is what makes flexography unique. The anilox roller meters the predetermined ink that is transferred for uniform thickness. It has engraved cells that carry a certain capacity of inks that can only be seen with a microscope. These rollers are responsible to transfer the inks to the flexible-plates that are already mounted on the Plate Cylinders.

3. Doctor Blade (Optional)

The doctor blade scrapes the anilox roll to ensure that the predetermined ink amount delivered is only what is contained within the engraved cells. Doctor blades have predominantly been made of steel but advanced doctor blades are now made of polymer materials, with several different types of beveled edges.

4. Plate Cylinder

The plate cylinder holds the printing plate, which is soft flexible rubber-like material. Tape, magnets, tension straps and/or ratchets hold the printing plate against the cylinder.

5. Impression Cylinder

The impression cylinder applies pressure to the plate cylinder, where the image is transferred to the substrate. This impression cylinder or "print Anvil" is required to apply pressure to the Plate Cylinder.

Presses

Stack Press

Color stations stack up vertically, which makes it easy to access. This press is able to print on both sides of the substrate.

Central Impression Press

All color stations are located in a circle around the impression cylinder. This press can only print on one side. Advantage: excellent registry In-Line Press Color stations are placed horizontally. This press prints on both sides, via a tumbar. Advantage: can print on heavier substrates, such as corrugated boards.

For maximum efficiency, the flexo presses produce large rolls of material that are then slit down to their finished size on slitting machines.

SUMMARY OF THE INVENTION

One aspect of the invention resides in a box made from 100% recycled paperboard made from a high percentage content of post-consumer waste content paper, which may contain mixed paper, retired books, old magazines, newspaper and old corrugated boxes. The paperboard is coated on both sides, with one side having an oily surface texture and the other side having a slick, but non-oily surface texture with selected portions left uncoated and thus are dry to which is applied a water-based adhesive.

BRIEF DESCRIPTION OF THE DRAWING

For a better understanding of the present invention, reference is made to the following description and accompanying drawings, while the scope of the invention is set forth in the appended claims. The patent or application file contains at least one drawing executed in color. Copies of this patent or patent application publication with color drawing(s) will be provided by the Office upon request and payment of the necessary fee.

For a better understanding of the present invention, reference is made to the following description and accompanying drawings, while the scope of the invention is set forth in the appended claims.

DETAILED DESCRIPTION OF THE INVENTION

The formation of a folding carton is conventional, for instance, as discussed in the Discussion of Related Art found in this patent application such as with respect to an article entitled FOLDING CARTONS, published online under the heading Packaging technology at http://packagingtech.net/56-folding-cartons.html?newsid=56.

Figure 4:
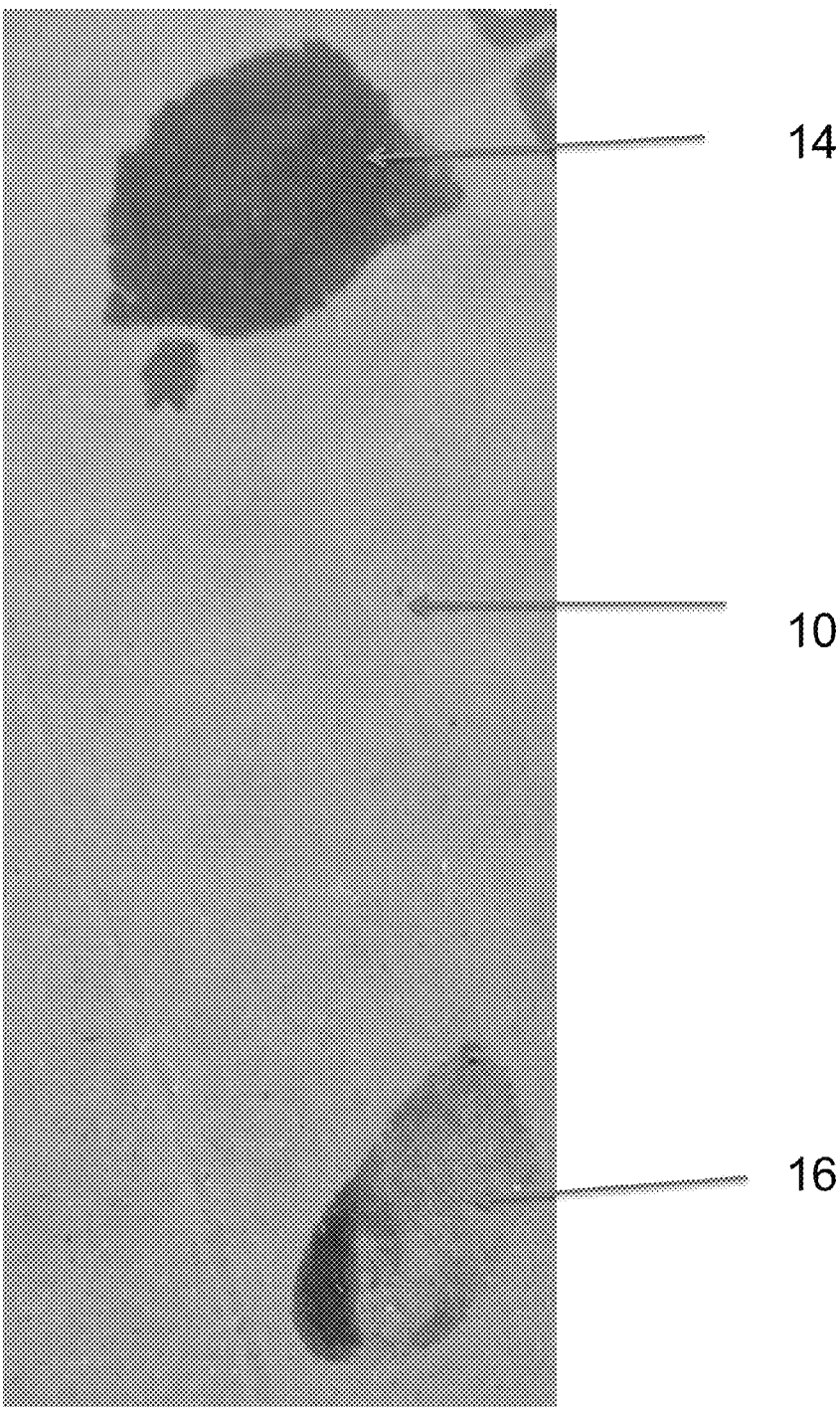
FIG. 4 (PRIOR ART)
FIG. 4 shows the effect of the water over time on the uncoated surface of the paperboard of FIG. 1 as well as the effect of oil applied to another region of the uncoated surface of the paperboard by lightly pressing the oil against it with a finger.
Figure 5:
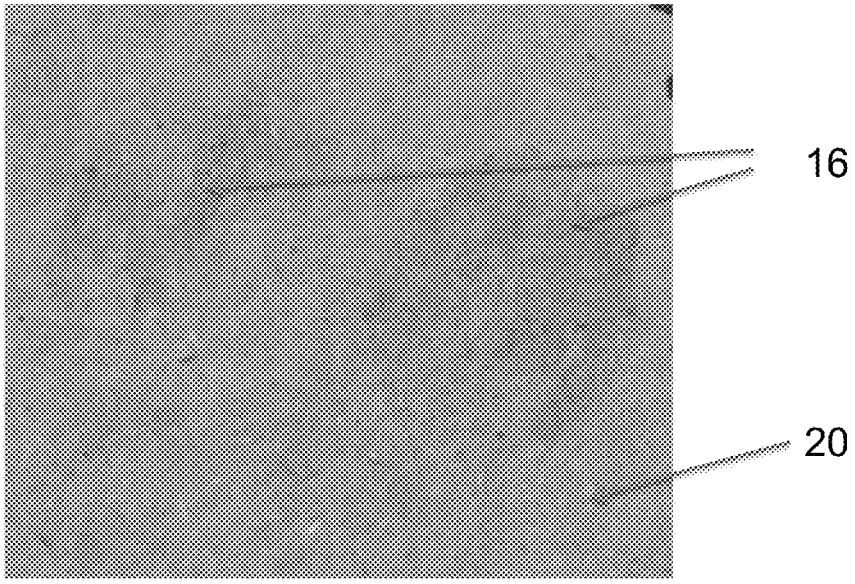
FIG. 5 shows the effect of a greasy fingerprint applied on the coated surface of paperboard of FIG. 2. in accordance with the invention.
Figure 6:
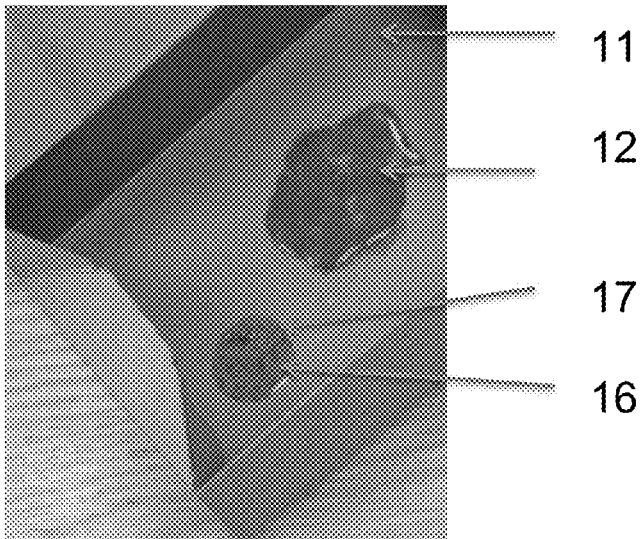
FIG. 6 (PRIOR ART)
FIG. 6 shows the effect of water and oil on an uncoated surface of a paperboard box in accordance with the prior art.
Figure 7:
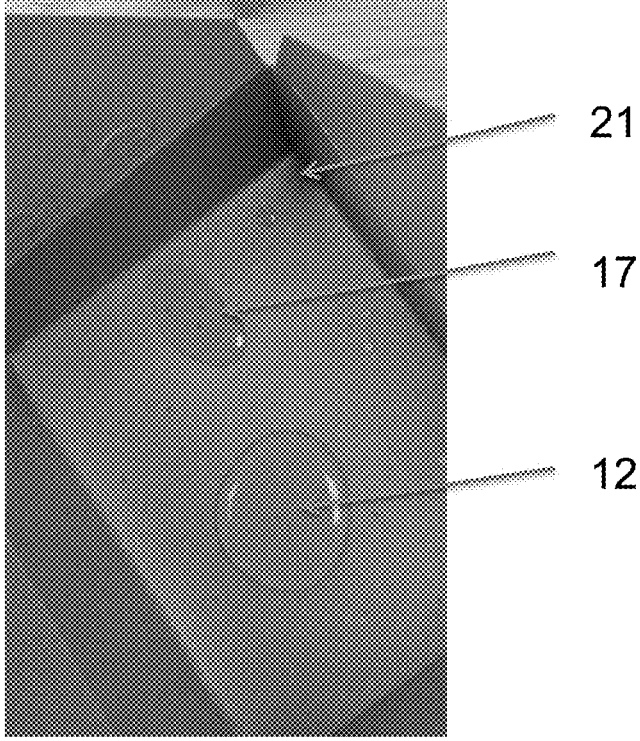
FIG. 7 shows the effect of water and oil a coated surface if a paperboard box in accordance with the invention.
Figure 8:
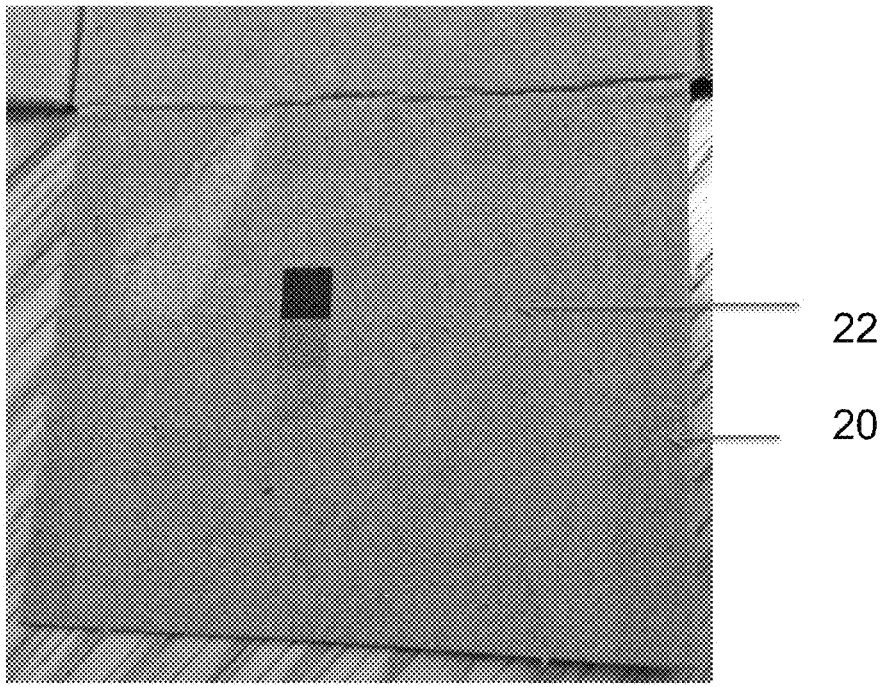
FIG. 8 shows a portion of the surface having an uncoated portion to which glue is applied on the same surface that is coated in accordance with that of FIG. 2.

FIGS. 1-8 are a series of photographs that are believed to be self-explanatory in showing the effect of depositing water 12 and oil or a greasy fingerprint 16 onto uncoated paperboard 10 and onto coated paperboard 20. In the case of the uncoated paperboard 10, a deposit of water 10 or oil 16 on its surface stains the topside of the paperboard as can be seen by the water stain 14 in FIGS. 1 and 4 the greasy oil stain 16 in FIG. 4. If there is a sufficient quantity of water deposited, for instance, the water seeps into pores of the paperboard to stain the underside of the paperboard as well as shown by the water stain 14 in FIG. 3. Such contrasts with the hydrophobic effect to water and oil deposited that the coated paperboard in accordance with the invention possesses (See FIGS. 2, 5 and 7) in which the staining is either nonexistent or considerably less noticeable or less evident than in the case of the water stain 14 of FIGS. 1 and 4 or the greasy fingerprint stain 16 of FIG. 4. Indeed, the water stain is non-existent in FIG. 2 and the greasy fingerprint stain 16 of FIG. 5 is much lighter than for the case of FIG. 4 and may even be considered to blend into the neighboring background of the exterior surface 20 so as to be less noticeable to the eye that the darkened stain 16 of FIG. 4.

Figure 1:
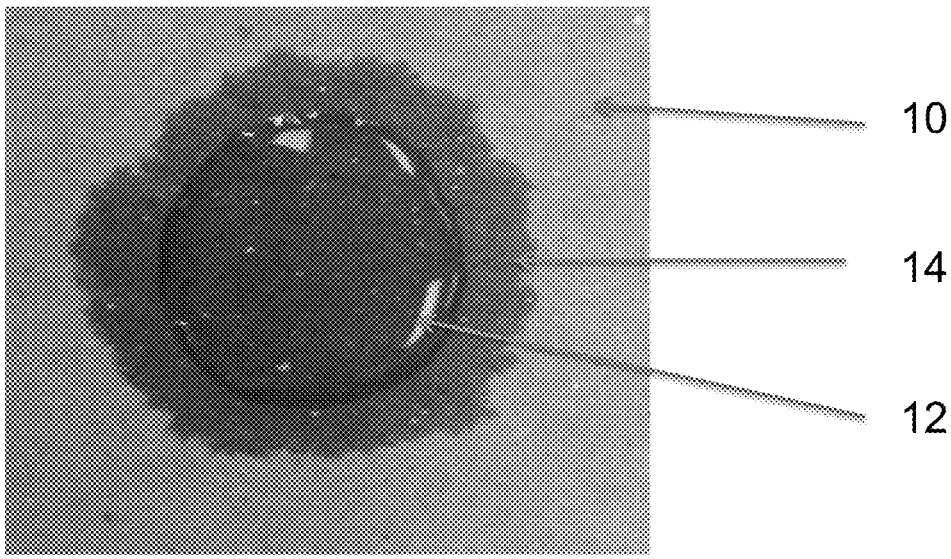
FIG. 1 (PRIOR ART)
FIG. 1 shows the effect of water on an uncoated surface of paperboard in accordance with the prior art.
Figure 2:
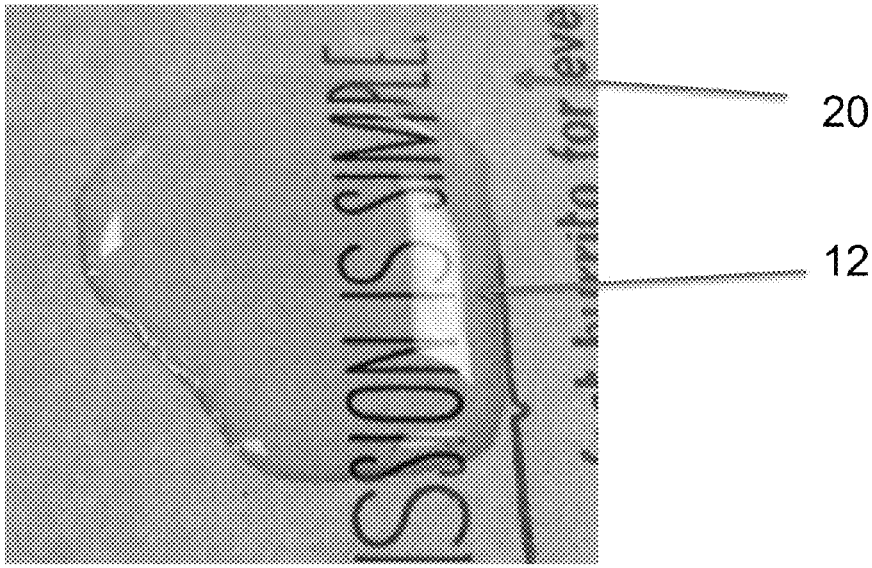
FIG. 2 shows the effect of water on a coated surface of paperboard in accordance with the invention, but also applies to the effect of oil on the coated surface.
Figure 3:
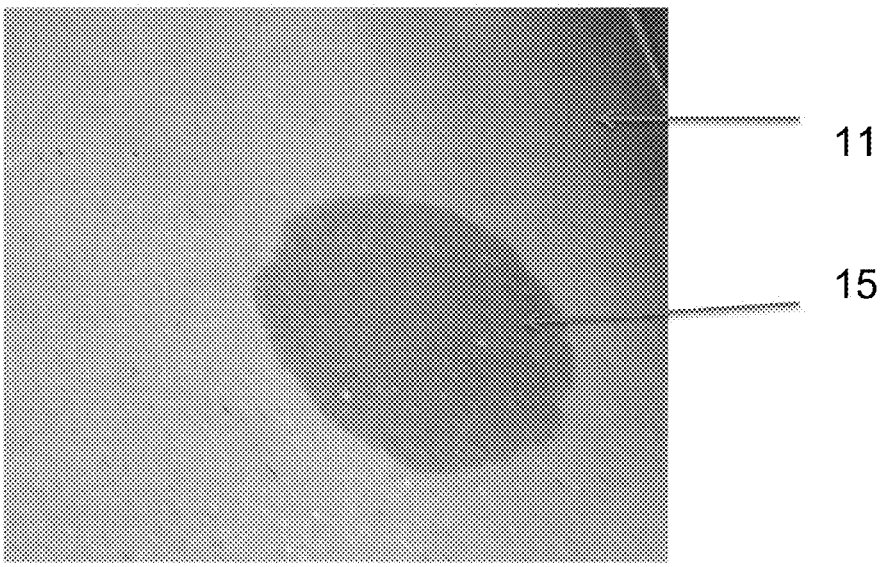
FIG. 3 (PRIOR ART)
FIG. 3 shows the effect of water seeping through to the opposite surface of the uncoated surface of paperboard of FIG. 1.

In addition, wiping the coated surface of the exterior surface 20 with a cloth or paper towel essentially removes the water of FIG. 2 or the grease of FIG. 5, which did little if any penetration of the pores in the paperboard to cause staining, unlike the case for the uncoated box of FIGS. 1 and 4 in which the water or grease stain penetrates the paperboard pores of the uncoated box to cause dark staining.

In accordance with the invention, the paperboard fibers that are used in the manufacture of paperboard are treated to kill off any lingering bacteria residing in them in a manner that is approved by the United States Food and Drug Administration (FDA) for use on a carton or packaging that is to contain food. Nevertheless, the paperboard is not resistant to staining even though its fibers may have been so treated. Such treatment does not prevent unsightly staining from arising when the paperboard is handled by one's greasy fingers as may occur during food packaging at a take-out establishment. This is because the hold-out, which is the resistance of fibers to fluid absorption, is not present for such fibers despite their treatment.

A grease resistance coating could be applied to the paperboard fibers themselves at the time of manufacture. Such a coating would improve the hold-out for such fibers. Even so, the present inventor has found that paperboard boxes made from such grease-resistant coated fibers still stain from greasy fingerprints.

A sheet of paperboard has two faces. Once the sheet is folded into a box as in FIGS. 6 and 7, one of the faces will have interior facing surfaces 11, 21 and the other face will have exterior facing surfaces 10, 20 when the box is closed.

In accordance with the invention, the interior facing surfaces 21 (see FIG. 7) are coated in a conventional manner such as with the MEYERCOTE grease-resistant coating that is petroleum based and thus will provide an oily surface texture with a glossy appearance. Portions of the exterior surfaces 20 (See FIGS. 2 and 5) will be coated in accordance with a water-based barrier coating with 35% to 45% solid suspension to have a slick surface texture that is not oily and a glazed appearance that has less light reflective shine than glossy. Such a water-based barrier coating is available in drums to the trade by requesting the water-based barrier coating under the tradename MEYERKOTE PLUS PASTRY COATING from Miami Valley Paper Company division of Mafcote Inc. The remaining portions 22 of the exterior surfaces 20 will be left uncoated since a water-based adhesive will be applied to them (see FIG. 8).

In order to apply the water-based coating, a two-station coating application with a conventional central impression flexographic printing press is used to coat the portions of the exterior facing surfaces. Each pass through the conventional central impression flexographic press entails passing the coated paperboard through a heated, forced air chamber that blooms the coating followed by letting the coating set on the surface of the paperboard without the heat and forced air being applied. The heating is to a temperature above that of room temperature, such as to 120 degrees Fahrenheit.

One station (of the conventional central impression flexographic printing press) carries a normal surfactant volume for the primer coat and another station carries ⅔ more in volume over that carried by the first station. During operation, the conventional central impression flexographic printing press first sizes the sheet of uncoated paperboard to be coated and applies the primer coat from one station.

At another station, the primer coated paperboard is coated again with an overcoat that has a higher volume of the same coating material as the primer coat, such as ⅔ more volume. Afterward, the finished sheet goes through a heating process that sets both coating applications, which blooms out solids from the coating composition to create a tight surface tension and closes the sheet's surface to render it hydrophobic, thereby giving it the desired resistance to stain and thus protects against staining from greasy fingerprints.

To achieve blooming, chemical additives in the water-based coating are heated above room temperature such as at 120 degrees Fahrenheit to tighten the surface tension sufficient for surfactant sealing and to repel liquid—rendering the surface hydrophobic. Without such heat, no blooming occurs—the present inventor has found that such does not prevent stains from greasy fingerprints. Further, the present inventor found that after the primer coat is applied, the paperboard is still open in its ability to absorb moisture, which is why the higher volume overcoat needs to be provided as well to create the proper surface tension that seals the paperboard against absorbing fluid and thus rendering it resistant to staining from greasy fingerprints.

Unlike the case for uncoated paperboard, the water-based coated paperboard after blooming appears glazed in appearance on the surface and has a slick and smooth surface texture. The slick surface texture is not oily. The glazed appearance is not as shiny as the glossy appearance that results from a petroleum-based coating.

The end result is a product that is 100% recycled, 100% recyclable, 85% post-consumer waste content (PCW) and is 100% compostable within 90 days in a properly managed landfill.

The conventional central impression flexographic printing press enables one to register selected portions of the paperboard to leave uncoated. Such regions are chosen where glue is to be applied to secure the box shape. The glue is preferably a water-based glue that has relatively low volatile organic compounds, unlike the case for petroleum-based glue.

While the foregoing description and drawings represent the preferred embodiments of the present invention, it will be understood that various changes and modifications may be made without departing from the scope of the present invention.

What is claimed is:

1. A container, comprising:

a paperboard having creases that fold the paperboard into a box shape that has exterior facing surfaces that face away from each other and interior facing surfaces that face each other;

a water-based barrier coating on portions of the exterior facing surfaces of the paperboard to coat the portions and that is configured to prevent staining from grease and water of the portions of the exterior facing surfaces of the paperboard that are coated, the water-based barrier coating having 35% to 45% solid suspension and being configured to exhibit a hydrophobic effect to deposits of water and oil, the exterior facing surfaces also having uncoated portions that are uncoated and thereby lack the water-based barrier coating, the water-based barrier coating including a primer coat layer applied on the paperboard with the paperboard remaining open to absorb moisture even though the primer coat is applied on the paperboard, an overcoat layer on the primer coat layer and having a higher volume of a same coating material than that of the primer coat layer, the primer coat and the overcoat together providing a surface tension necessary to seal the paperboard against absorbing fluid and resist staining from greasy fingerprints; and a water-based adhesive adhering the uncoated portions of the exterior facing surfaces to portions of the interior facing surfaces that are in alignment therewith.

2. The container of claim 1, wherein the paperboard has post-consumer waste content paper selected from the group consisting of mixed paper, retired books, magazines, newspaper, corrugated boxes, and any combination thereof.

3. The container of claim 1, wherein the paperboard has fibers treated to kill off bacteria residing in the fibers.

4. The container of claim 1, further comprising:

a petroleum-based coating on the interior facing surfaces the water-based barrier coating on the exterior facing surfaces being less light reflective than the petroleum-based coating on the interior facing surfaces.

5. The container of claim 1, in combination with:

a water deposit on the water-based barrier coating, the water-based barrier coating resisting seepage penetration of the water deposit into pores of the paperboard so that the paperboard is free of stain from the water deposit.

6. The container of claim 1, in combination with:

a grease deposit on the water-based barrier coating, the water-based barrier coating resisting seepage penetration of the grease deposit into pores of the paperboard.

7. The container of claim 1, wherein the water-based barrier coating provides a smooth surface texture and a glazed appearance.

8. The container of claim 4, wherein the petroleum-based coating provides an oily surface texture and a glossy appearance.

9. The container of claim 1, wherein the interior facing surfaces including a pair of opposite interior facing surfaces that face each other, the exterior facing surfaces including a pair of opposite exterior facing surfaces that face away from each other.

10. The container of claim 1, wherein the paperboard has grease-resistant coated fibers.

11. The container of claim 1, wherein the overcoat layer has a volume that is ⅔ greater than a volume of the primer layer.

12. The container of claim 1, wherein the water-based barrier coating is other than that of a clay-based coating.

13. A container, comprising:

a paperboard having creases that fold the paperboard to fold into a box shape that has exterior facing surfaces and interior facing surfaces, the interior facing surfaces including pair of opposite interior facing surface that face each other, the exterior facing surfaces including pairs of opposite exterior facing surfaces that face away from each other;

a water-based barrier coating on portions of the exterior facing services of the paperboard to coat the portions and that is configured to prevent staining from grease and water of the portions of the exterior facing surfaces of the paperboard that are coated, the water-based barrier coating having 35% to 45% solid suspension and being configured to exhibit a hydrophobic effect to deposits of water and oil, the water-based barrier coating including a primer coat layer applied on the paperboard with the paperboard remaining open to absorb moisture even though the primer coat is applied on the paperboard, an overcoat layer on the primer coat layer and having a higher volume of a same coating material than that of the primer coat layer, the primer coat and the overcoat together providing a surface tension necessary to seal the paperboard against absorbing fluid and resist staining from greasy fingerprints; and a petroleum-based coating on the interior facing surfaces the water-based barrier coating of the exterior facing surfaces being less light reflective than the petroleum-based coating on the interior facing surfaces.

14. The container of claim 13, wherein the water-based barrier coating provides a smooth surface texture and a glazed appearance and the oil-based coating provides an oily surface texture and a glossy appearance.

15. The container of claim 13, wherein the overcoat layer has a volume that is ⅔ greater than a volume of the primer layer.

16. The container of claim 13, wherein the water-based barrier coating is other than that of a clay-based coating.

* * * * *